US011371259B2

(12) United States Patent
Wesley

(10) Patent No.: US 11,371,259 B2
(45) Date of Patent: Jun. 28, 2022

(54) DEVICE AND METHOD FOR SECURING A DEADBOLT DOOR LOCK

(71) Applicant: Troy L. Wesley, Columbus, OH (US)

(72) Inventor: Troy L. Wesley, Columbus, OH (US)

(73) Assignee: TLW Marketing Group LLC, Columbus, OH (US)

( * ) Notice: Subject to any disclaimer, the term of this patent is extended or adjusted under 35 U.S.C. 154(b) by 38 days.

(21) Appl. No.: 16/894,724

(22) Filed: Jun. 5, 2020

(65) Prior Publication Data

US 2021/0095495 A1 Apr. 1, 2021

Related U.S. Application Data

(60) Provisional application No. 62/973,266, filed on Sep. 26, 2019.

(51) Int. Cl.

| | |
|---|---|
| ***E05B 13/04*** | (2006.01) |
| ***E05B 13/00*** | (2006.01) |
| ***E05B 1/00*** | (2006.01) |

(52) U.S. Cl.

CPC ..... *E05B 13/04* (2013.01); *E05B 1/003* (2013.01); *E05B 13/001* (2013.01); *E05B 13/002* (2013.01); *E05Y 2600/51* (2013.01); *E05Y 2800/266* (2013.01)

(58) Field of Classification Search

CPC ..... E05B 1/003; E05B 13/001; E05B 13/002; E05B 13/007; E05B 13/04; E05Y 2600/51; E05Y 2800/266

See application file for complete search history.

(56) References Cited

U.S. PATENT DOCUMENTS

| | | | | |
|---|---|---|---|---|
| 2,515,364 A | | 7/1950 | Weaver | |
| 3,423,974 A | * | 1/1969 | Bernsley | E05B 13/002 70/416 |
| 3,585,827 A | | 6/1971 | Dominguez | |
| 3,748,882 A | * | 7/1973 | Dusault, Jr. | E05B 13/001 70/447 |
| 4,279,137 A | | 7/1981 | Cook | |
| 4,869,086 A | * | 9/1989 | Richards | E05B 13/002 70/210 |
| 5,003,803 A | * | 4/1991 | Richards | E05B 13/002 70/210 |
| 5,035,128 A | | 7/1991 | Ringway | |
| 5,313,812 A | * | 5/1994 | Eklund | E05B 13/04 70/416 |

(Continued)

*Primary Examiner* — Christopher J Boswell

(74) *Attorney, Agent, or Firm* — Porter, Wright, Morris & Arthur, LLP

(57) ABSTRACT

Disclosed is a security device for securing a deadbolt door lock having an interior face plate and a lever movable between a locked position and an unlocked position. The security device includes a base member configured to be secured to the interior face plate of the deadbolt lock, and a lock member pivotably secured to the base member so that the lock member pivots between an open position and a closed position. The lock member is configured to prevent movement of the lever from the locked position to the unlocked position when the lock member is in the closed position and to permit movement of the lever from the locked position to the unlocked position when the lock member is in the open position.

20 Claims, 10 Drawing Sheets

(56) References Cited

U.S. PATENT DOCUMENTS

| | | | | | |
|---|---|---|---|---|---|
| 5,369,971 | A * | 12/1994 | Sheppard | E05B 13/001 | 70/416 |
| 5,651,279 | A * | 7/1997 | Berton | E05B 13/001 | 292/359 |
| 5,950,465 | A * | 9/1999 | Schultz | E05B 13/04 | 70/416 |
| 6,182,485 | B1 | 2/2001 | Moore | | |
| 6,301,941 | B1 | 10/2001 | Nicholsgueiredo | | |
| 6,742,369 | B1 * | 6/2004 | Veillette | E05B 13/002 | 70/211 |
| 6,993,944 | B2 | 2/2006 | Hicks | | |
| 7,418,847 | B2 * | 9/2008 | Kosi | E05B 13/04 | 292/288 |
| 7,918,116 | B2 * | 4/2011 | Quach | E05B 13/002 | 70/416 |
| 8,794,041 | B2 * | 8/2014 | Daniels | E05B 13/04 | 70/211 |
| 9,644,395 | B2 | 5/2017 | Strand | | |
| D933,452 | S * | 10/2021 | Wesley | E05B 13/04 | D8/336 |
| 2009/0013739 | A1 * | 1/2009 | Vyskocil, Jr. | E05B 13/04 | 70/416 |
| 2012/0222459 | A1 | 9/2012 | Glazer | | |
| 2020/0347639 | A1 * | 11/2020 | Mano | E05B 13/04 | |

* cited by examiner

DEVICE AND METHOD FOR SECURING A DEADBOLT DOOR LOCK

CROSS-REFERENCE TO RELATED APPLICATIONS

This application claims the priority benefit of U.S. Provisional Patent Application No. 62/973,266, filed on Sep. 26, 2019, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF INVENTION

The field of invention generally relates to devices and methods for securing doors, and, more particularly, to devices and methods for securing deadbolt door locks.

BACKGROUND OF THE INVENTION

Many doors have deadbolt locks which may be unlocked with a key from the exterior side of the door. Typically, these deadbolt door locks have an interior assembly including a cylinder face cover or plate which hides the internal workings of the lock and a thumb-turn lever which actuates the lock from the interior side of the door. Often, the cylinder face cover is attached by way of a plurality of screws, or other mechanical fasteners, which hold the cover in position in conjunction with the inner lock and the thumb-turn lever. With that said, often deadbolt door locks which have not been rekeyed over the years may have numerous duplicated keys floating around which may be held or obtained by unauthorized people. Additionally, landlords typically retain keys for rental and leased properties which can be stolen or "borrowed" for unauthorized use. Typical deadbolt door locks have no way of preventing one of these rogue keys from being utilized, thus opening the opportunity for intruders to potentially gain unauthorized access to the interior side of the door by way of a key.

There are a great number of reasons why someone may want to prevent another person from gaining keyed access to their residence or other building, such as an abusive family member or landlord, or a former resident of the property. People who suffer from anxieties caused by conditions like OCD, PTSD, and Dementia often feel more secure with knowledge that the door is locked and cannot be unlocked without their knowledge and consent. Additionally, both groups enjoy a place to hang their keys that is convenient and easily accessible.

Solutions like door chains and slide bolts often attach to the door frame rather than the house frame and can be easily destroyed if an intruder has a key for the door lock(s). Deadbolt locks connect the door frame to the house frame and are difficult to override so long as the key and/or thumb-turn lever cannot be turned.

Accordingly, there is a need for improved security devices and methods for securing deadbolt locks.

SUMMARY OF THE INVENTION

Disclosed are devices and methods for securing deadbolt locks that overcome at least some of the above-described problems associated with the prior art. Disclosed is a device for securing a deadbolt lock having an interior face plate and a lever movable between locked and unlocked positions. The device comprises, in combination, a base member configured to be secured to the interior face plate, and a lock member pivotably secured to the base member so that the lock member pivots between an open position and a closed position. The lock member is configured to prevent movement of the lever from the locked position to the unlocked position when the lock member is in the closed position and to permit movement of the lever from the locked position to the unlocked position when the lock member is in the open position Also disclosed a combination of a deadbolt lock and a security device. The deadbolt lock includes an interior face plate and a lever movable between a locked position and an unlocked position. The security device includes a base member configured to be secured to the interior face plate, and a lock member pivotably secured to the base member so that the lock member pivots between an open position and a closed position. The lock member is configured to prevent movement of the lever from the locked position to the unlocked position when the lock member is in the closed position and to permit movement of the lever from the locked position to the unlocked position when the lock member is in the open position.

Further disclosed is a method for securing a deadbolt lock having an interior face plate and a lever movable between locked and unlocked positions. The method comprising the step of obtaining a security device including a base member secured to the deadbolt lock and a lock member pivotably secured to the base member so that the lock member pivots between an open position and a closed position. The lock member is configured to prevent movement of the lever from the locked position to the unlocked position when the lock member is in the closed position and to permit movement of the lever from the locked position to the unlocked position when the lock member is in the open position. The method further comprises the steps of pivoting the lock member from the open position to the closed position when the lever is in the locked position to prevent movement of the lever from the locked position to the unlocked position, and pivoting the lock member from the closed position to the open position to permit movement of the lever from the locked position to the unlocked position.

From the foregoing disclosure and the following more detailed description of various preferred embodiments it will be apparent to those skilled in the art that the present invention provides a significant advance in the technology and art of devices and methods for securing deadbolt locks. Particularly significant in this regard is the potential the invention affords for providing a solution that is relatively inexpensive and easy to install and use. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
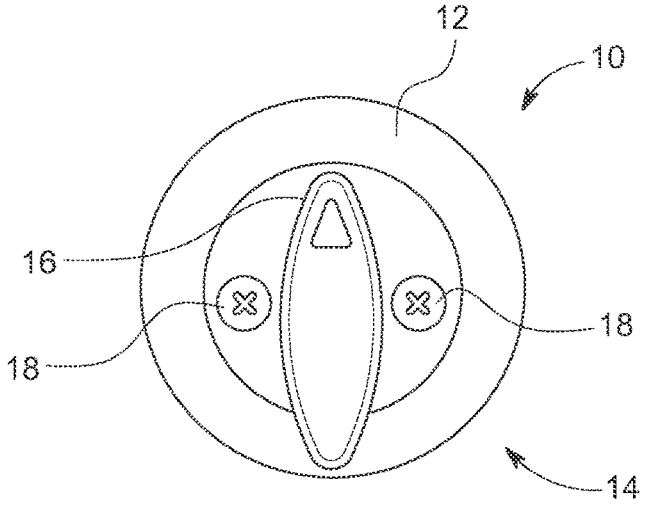
FIG. 1 is a view of an interior side of a door in the area of a deadbolt door lock having an interior face plate or cover secured in place with a pair of laterally-spaced screws at opposed thumb-turn lever or handle according to the prior art.

It should be understood that the appended drawings are not necessarily to scale, presenting a somewhat simplified representation of various preferred features illustrative of the basic principles of the invention. The specific design features of the security devices as disclosed herein, including, for example, specific dimensions and shapes of the various components will be determined in part by the particular intended application and use environment. Certain features of the illustrated embodiments may be enlarged or distorted relative to others to facilitate visualization and clear understanding. In particular, thin features may be thickened, for example, for clarity or illustration. All references to direction and position, unless otherwise indicated, refer to the orientation of the components illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the devices and methods for securing deadbolt door locks disclosed herein. The following detailed discussion of various alternative and preferred embodiments will illustrate the general principles of the invention. Other embodiments suitable for other applications will be apparent to those skilled in the art given the benefit of this disclosure.

FIG. 1 illustrates an exemplary deadbolt door lock 10 having an interior face plate 12 located at an interior side of a door 14 and a pivoting lever 16 inwardly extending away from the door 14 and the face plate 12. The pivoting lever 16 is pivotably movable between a vertically-extending locked position to lock the deadbolt lock 10 and an angled unlocked position to unlock the deadbolt lock 10. The interior face plate 12 is secured to the deadbolt lock 10 by a pair of laterally spaced-apart mechanical fasteners 18, in the form of screws, located on opposite sides of the center of the pivoting lever 16 when in the vertically-extending locked position. It is noted that the deadbolt door lock 10 can alternatively have any other suitable configuration.

Figure 2:
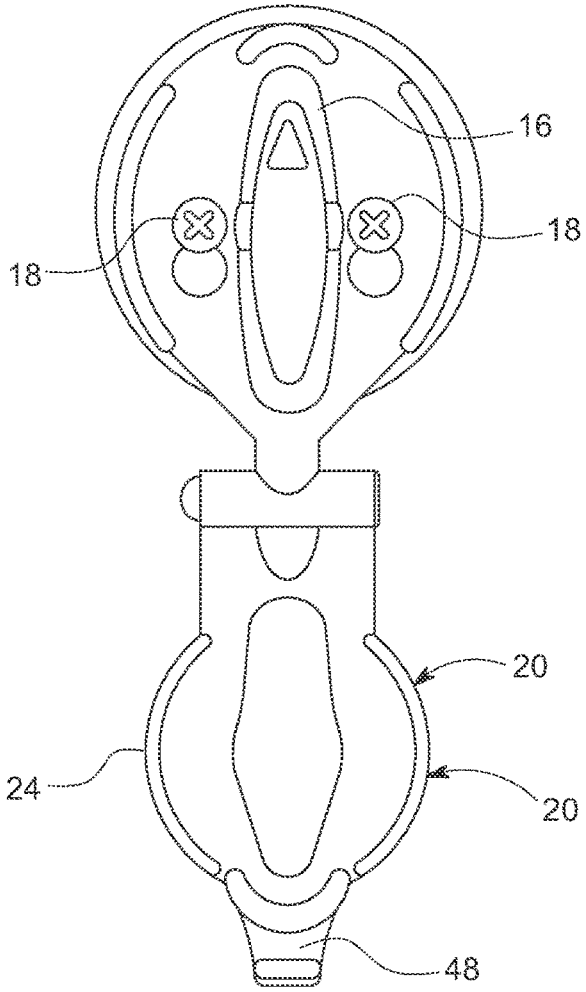
FIG. 2 is a view of a security device according to a first embodiment of the present invention installed to the deadbolt door lock of FIG. 1, wherein the security device is in an open or unlocked configuration and the deadbolt lever is in a locked position.
Figure 3:
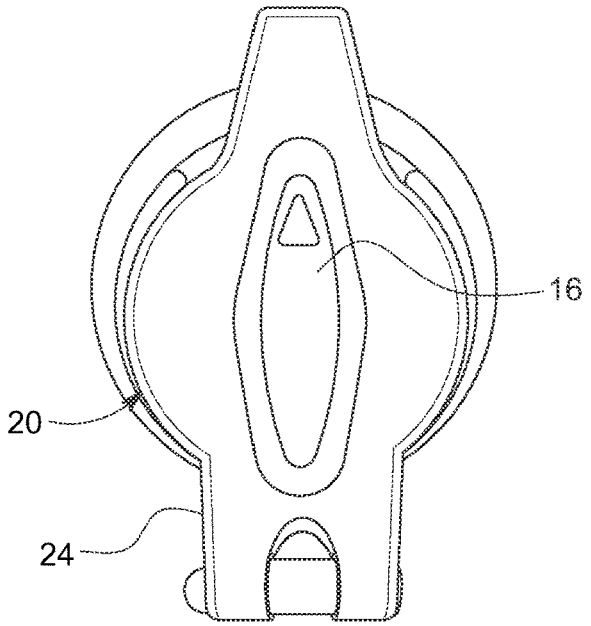
FIG. 3 is a view of the installed security device of FIGS. 2 and 2A, wherein the security device is in a closed or locked configuration and the deadbolt lever is in the locked position.

FIGS. 2 and 3 illustrate a security device 20 attached to the deadbolt door lock 10 according to the present invention. As best seen in FIGS. 4 to 15, the illustrated security device 20 includes a base member 22 configured to be secured to the interior face plate 12 of the deadbolt door lock 10, and a lock member 24 pivotably secured to the base member 22 so that the lock member 24 pivots between an open or unlocked position and a closed or locked position. The lock member 24 is configured to prevent movement of the pivoting lever 16 of the deadbolt door lock 10 from its locked position to its unlocked position when the lock member 24 is in its closed position and to permit movement of the pivoting lever 16 of the deadbolt door lock 10 from its locked position to its unlocked position when the lock member 24 is in its open or unlocked position.

The illustrated base member 22 includes a generally circular shaped rear wall 26. The rear wall 26 is sized and shaped to engage and be secured to the interior face plate 12 of the deadbolt door lock 10. A central opening 28 is sized and shaped so that the pivoting lever 16 can be passed therethrough and pivot while the rear wall 26 is between the interior faceplate 12 and the pivoting lever 16. A pair of fastener openings 30 are provided on opposite sides of the central opening 28 for passage of the fasteners 18 of the deadbolt door lock 10 therethrough to secure the base member 22 to the interior face plate 12. The illustrated fastener openings 30 are each keyway shaped having a large diameter forming a clearance opening for the heads of the fasteners 18 and a small diameter portion to be engaged by the heads of the fasteners 18 to clamp the base member 22 between the heads of the fasteners 18 and the interior faceplate 12. Shaped in this manner, the base member 22 can be secured to the interior faceplate 12 without entirely removing the fasteners 18. First, the fasteners 18 are loosened so that the fastener heads can be passed through the large diameter portion of the fastener openings 30. Second, the fasteners 18 are slid to the small diameter portion of the fastener openings 30 and the fasteners 18 are tightened to clamp the base member 22 to the interior faceplate 12. It is noted that the fastener openings 30 can alternative have any other suitable configuration. Left and right edges of the rear wall are provided with left and right flanges 32, 34 that inwardly extend. That is, extend outwardly away from the interior side of the door 14. The flanges 32, 34 have a length that extends along a substantial portion of the central opening 28 and have a height that permits pivoting movement of the pivoting lever 16. The top of the illustrated rear wall is provided with a first or male clasp or latch member 36 that cooperates with a second or female clasp member 38 of the lock member 24 to form a clasp 35 that removably secures the lock member 24 to the base member 22 as described in more detail below. Provided at the bottom of the rear wall is a horizontal and laterally extending passage 40 which cooperates with the lock member 24 to receive a pivot member or pin 42 to pivotably connect the lock member 24 to the base member 22 as described in more detail hereinbelow. It is noted that the base member 22 can alternatively have any other suitable configuration. It is also noted that that the base member 22 can comprise any suitable material such as, but not limited to, metal, plastic, composite and the like and the base member preferably comprises plastic.

Figure 2A:
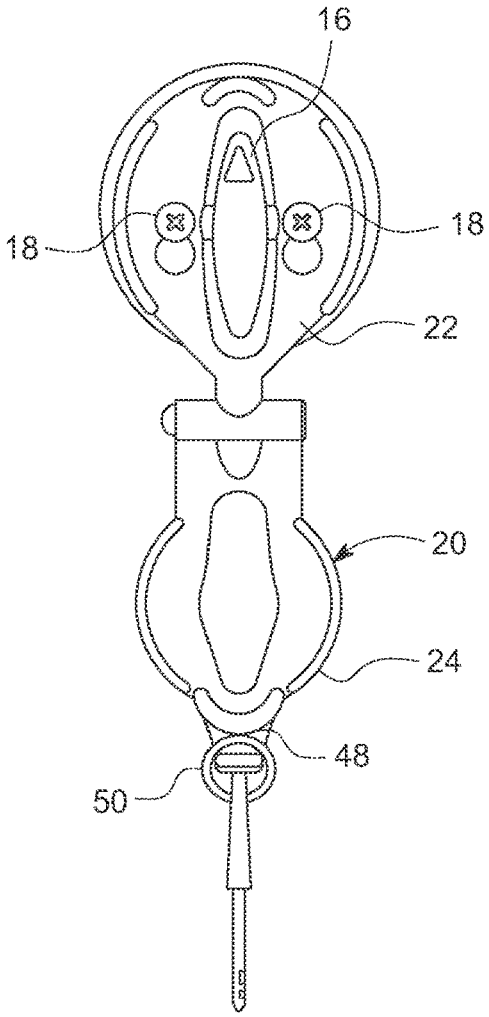
FIG. 2A is a view of the installed security device of FIG. 2, but wherein a keyring is on a key ring holder of the security device.
Figure 3A:
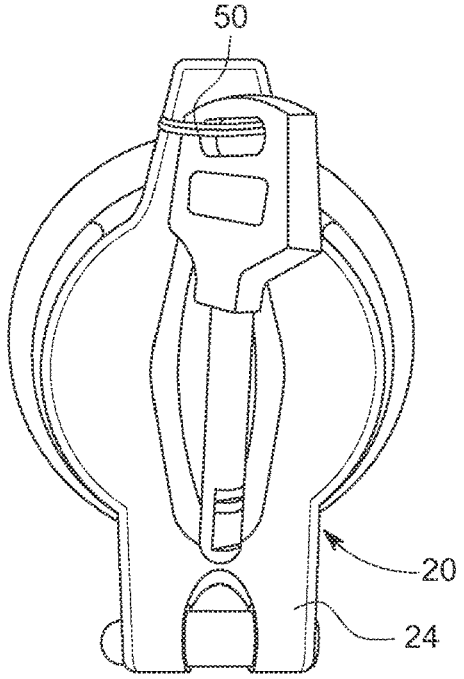
FIG. 3A is a view of the installed security device of FIG. 3, but wherein a keyring is on the key ring holder of the security device.
Figure 4:
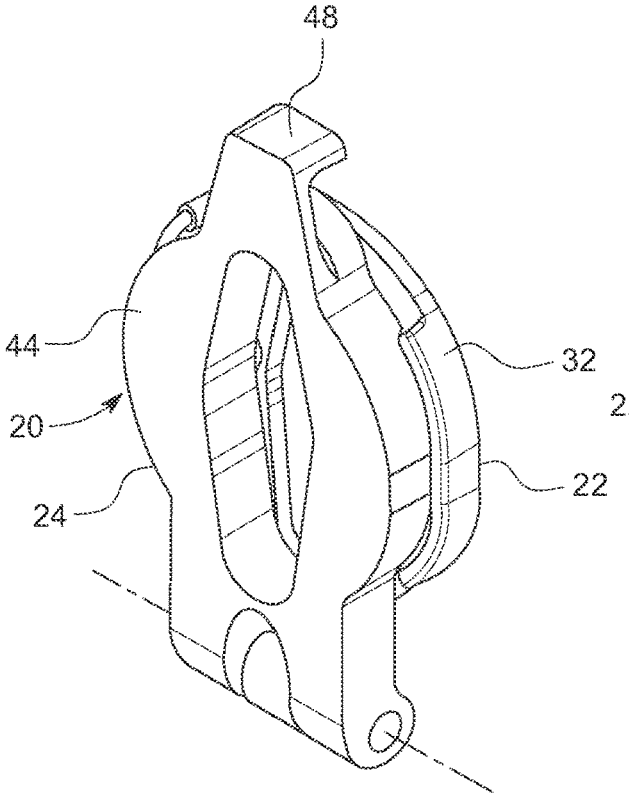
FIG. 4 is a front prospective view of the security device of FIGS. 2 and 3, wherein the security device is in a closed or locked configuration.
Figure 5:
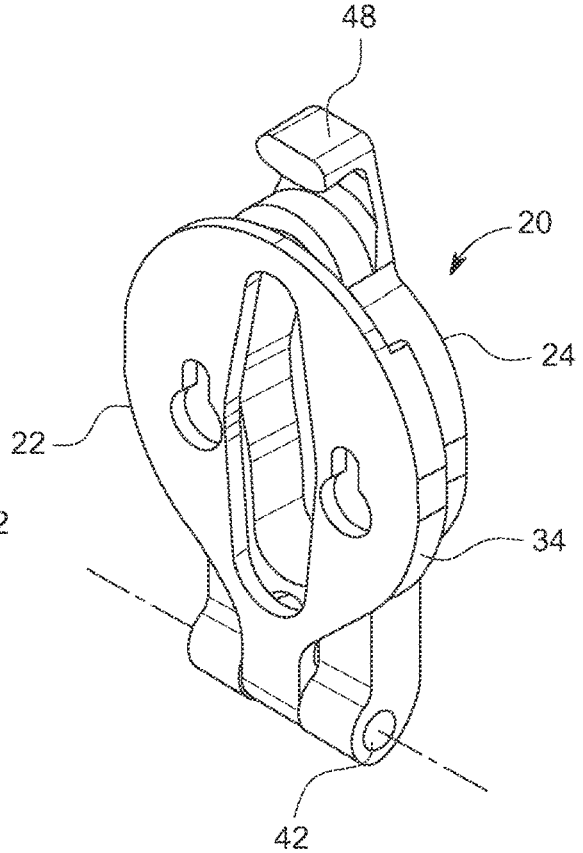
FIG. 5 is a rear prospective view of the security device of FIG. 4.
Figure 6:
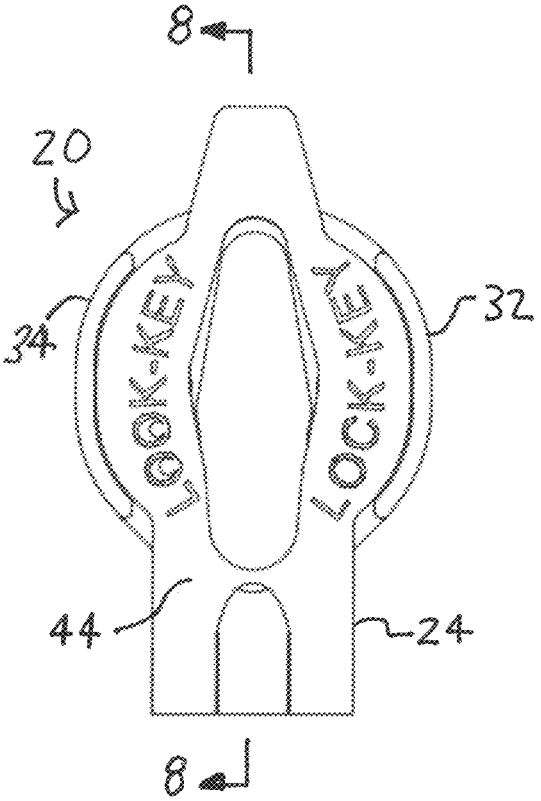
FIG. 6 is a front view of the security device of FIGS. 4 and 5.
Figure 7:
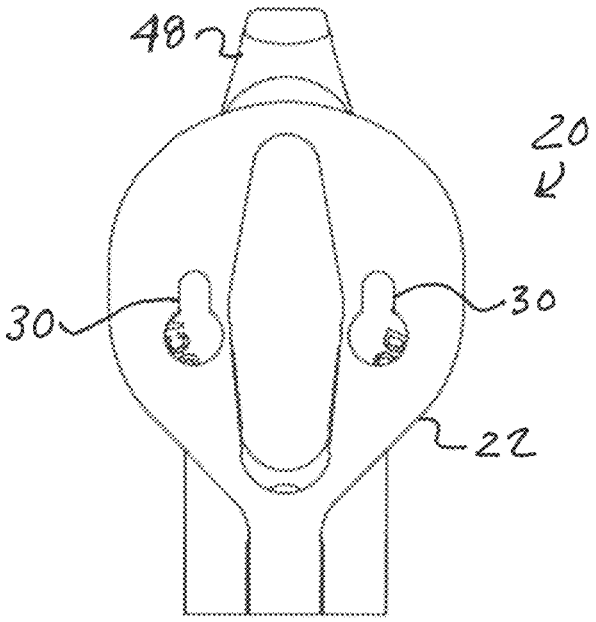
FIG. 7 is a rear view of the security device of FIGS. 4 to 6.
Figure 8:
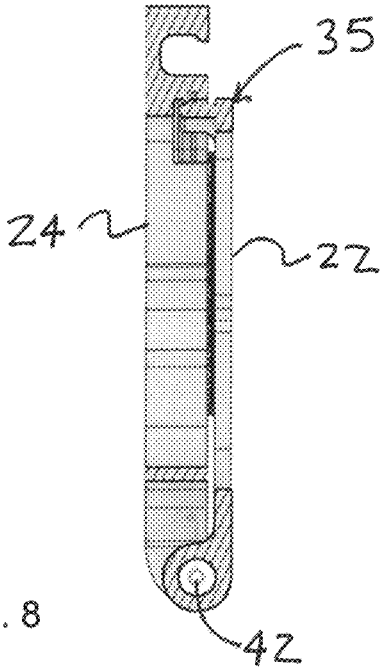
FIG. 8 is cross section view of the security device of FIGS. 4 to 7 taken along line 8-8 of FIG. 6.
Figure 9:
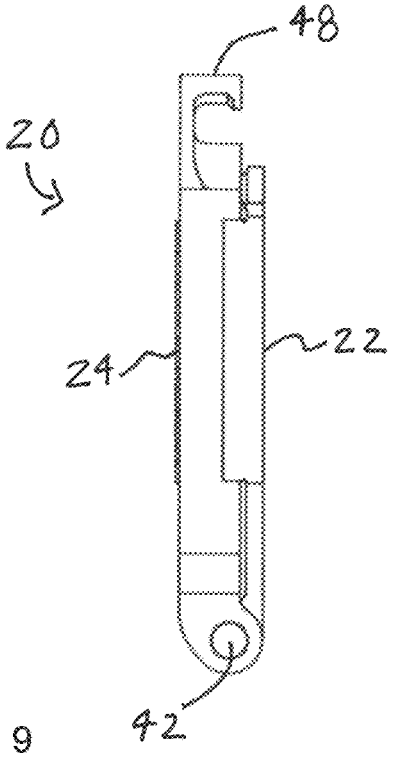
FIG. 9 is a right-side view of the security device of FIGS. 4 to 8.
Figure 10:
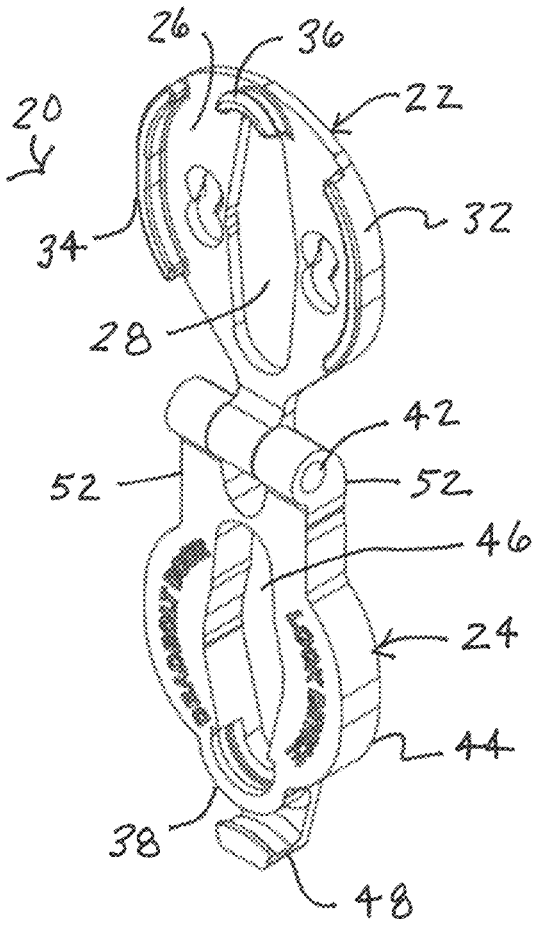
FIG. 10 is a front prospective view of the security device of FIGS. 2 and 3, wherein the security device is in an open or unlocked configuration.
Figure 11:
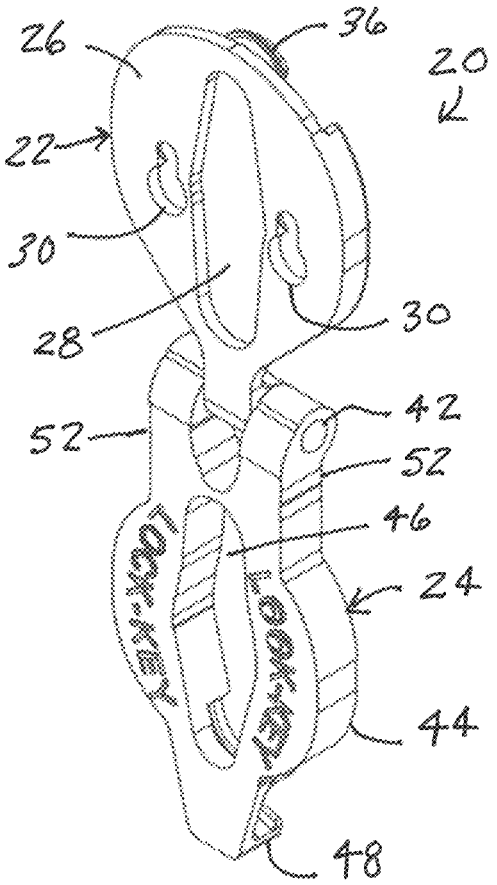
FIG. 11 is a rear prospective view of the security device of FIG. 10.
Figure 12:
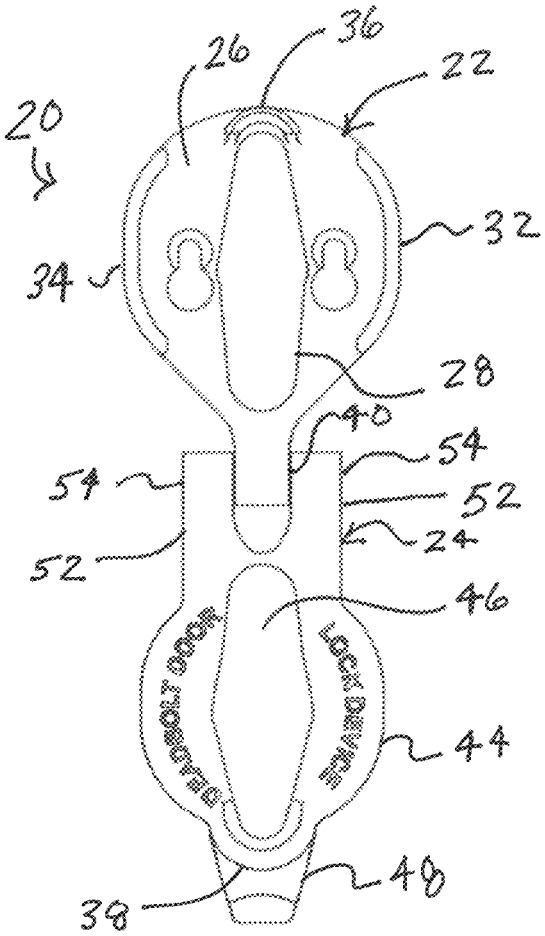
FIG. 12 is a front view of the security device of FIGS. 10 and 11.
Figure 13:
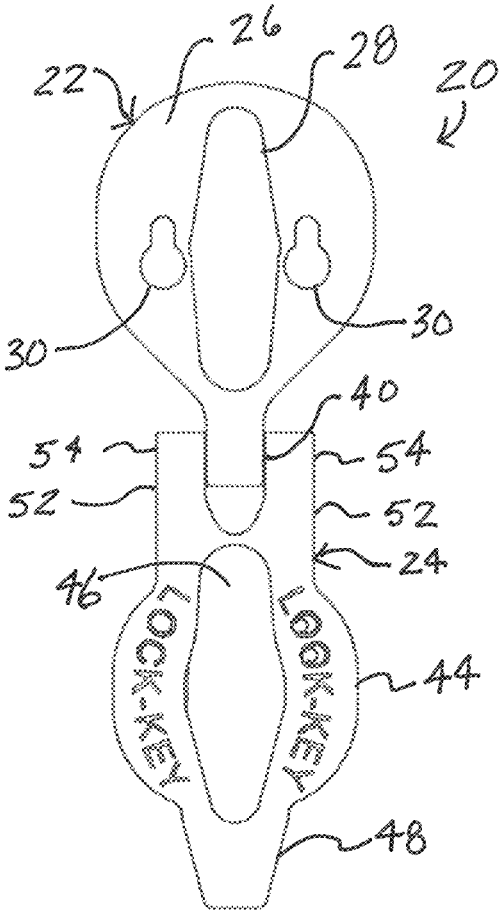
FIG. 13 is a rear view of the security device of FIGS. 10 to 12.
Figure 12A:
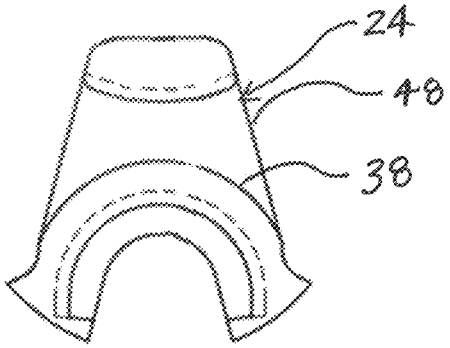
FIG. 12A is an enlarged fragmented view taken from of FIG. 12.
Figure 14:
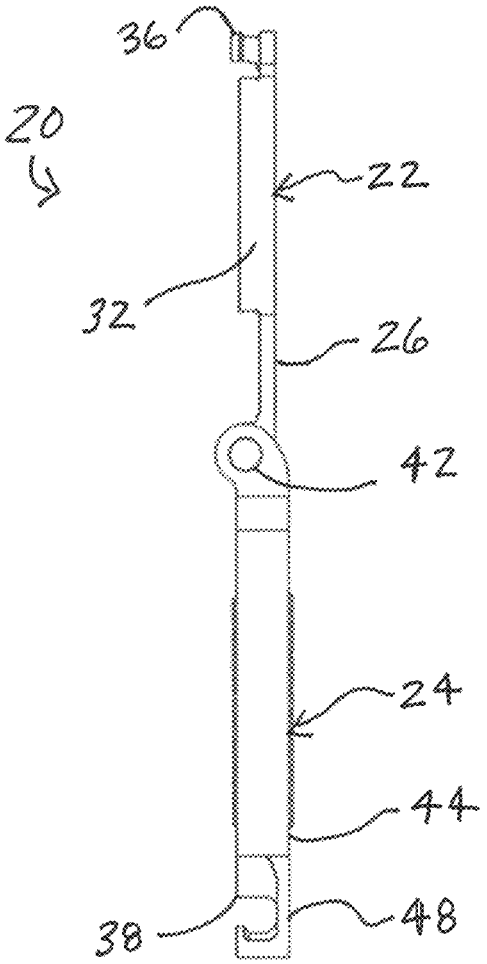
FIG. 14 is a right-side view of the security device of FIGS. 10 to 13
Figure 14A:
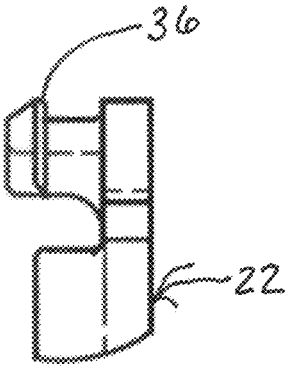
FIG. 14A is an enlarged fragmented view taken from of FIG. 14.
Figure 14B:
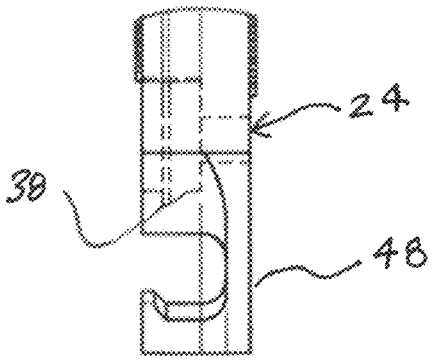
FIG. 14B is an enlarged fragmented view taken from of FIG. 14.

The illustrated lock member 24 includes a generally circular shaped main wall 44. The main wall 44 is sized and shaped to be received at the rear wall 26 of the base member 22 between the flanges 32, 34. A central opening 46 is sized and shaped so that the pivoting lever 16 can be received when in its locked position to prevent motion of the pivoting lever 16 that would unlock the deadbolt door lock 10. The top of the illustrated main wall 44 is provided with the second or female clasp or latch member 38 that cooperates with the first or male clasp or latch member 36 of the base member 22 to form the clasp 35 that removably secures the lock member 24 to the base member 22 as described in more detail below. The top of the main wall 44 is provided with a hook 48 that is downward directed and rearward facing when the lock member 24 is in its locked position. The hook 48 sized and shaped to hang a keyring 50 thereon (best shown in FIG. 2A). When the lock member 24 is pivoted down to its unlocked position, the hook 48 is upward directed and forwardly facing to hang a keyring 50 thereon (best shown in FIG. 3A). The bottom of the main wall 44 is provided with a pair of downwardly extending legs 52 sized and shaped to extend adjacent the lateral ends of the bottom of the base member 22 at the passage 40. The legs 52 are provided with horizontal and laterally extending passages 54 which cooperate with the passage 40 of the base member 22 to receive the pivot member or pin 42 to pivotably connect the lock member 24 to the base member 22 as described in more detail hereinbelow. It is noted that the lock member 24 can alternatively have any other suitable configuration. It is also noted that that the lock member 24 can comprise any suitable material such as, but not limited to, metal, plastic, composite and the like. The lock member 24 preferably comprises plastic.

Figure 15:
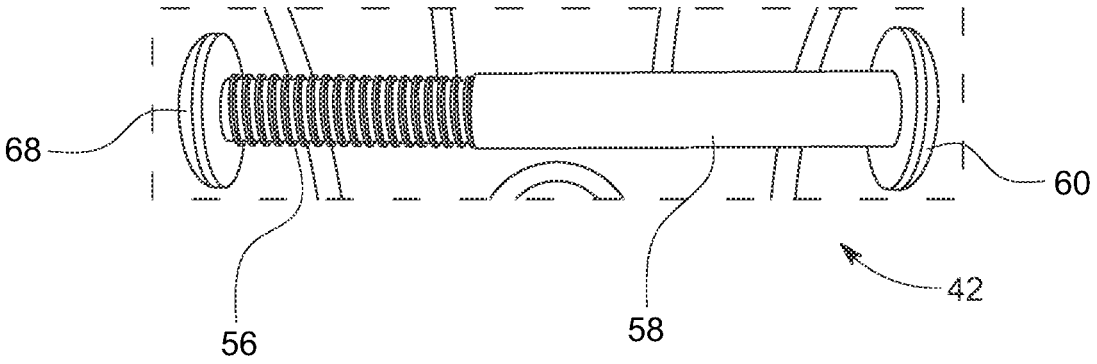
FIG. 15 is a view of an exemplary pivot pin of the security device of FIGS. 4 to 14.
Figure 16:
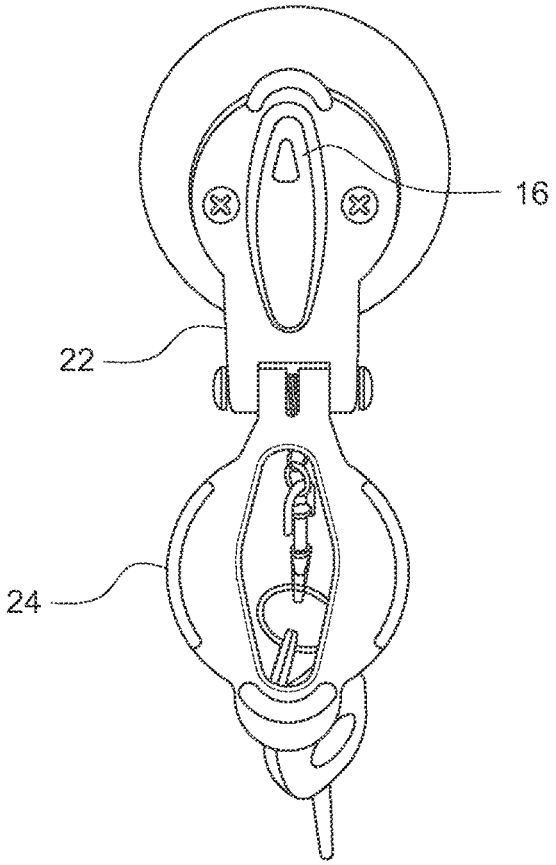
FIG. 16 is a view of a security device according to a second embodiment of the present invention installed to the deadbolt door lock of FIG. 1, wherein the security device is in an open or unlocked configuration and the deadbolt lever is in a locked position.
Figure 16A:
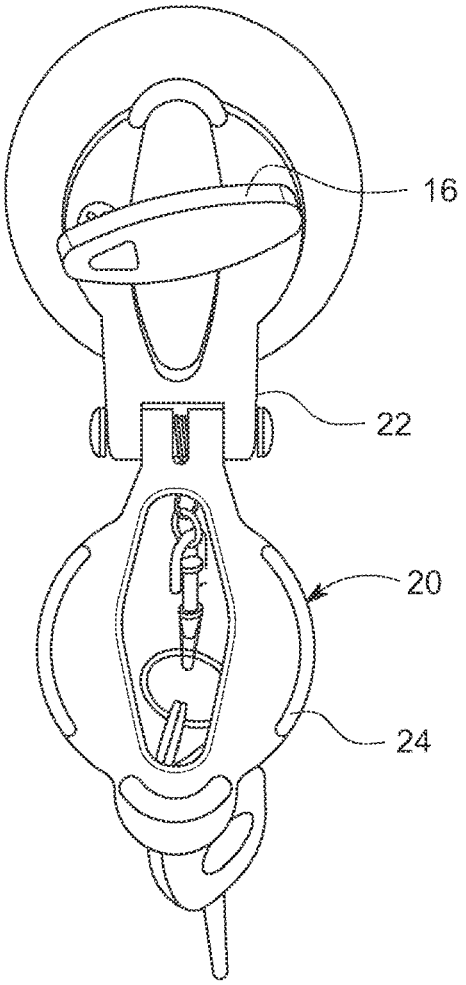
FIG. 16A is a view of the installed security device of FIG. 16 but wherein the deadbolt lock is in an unlocked position.
Figure 17:
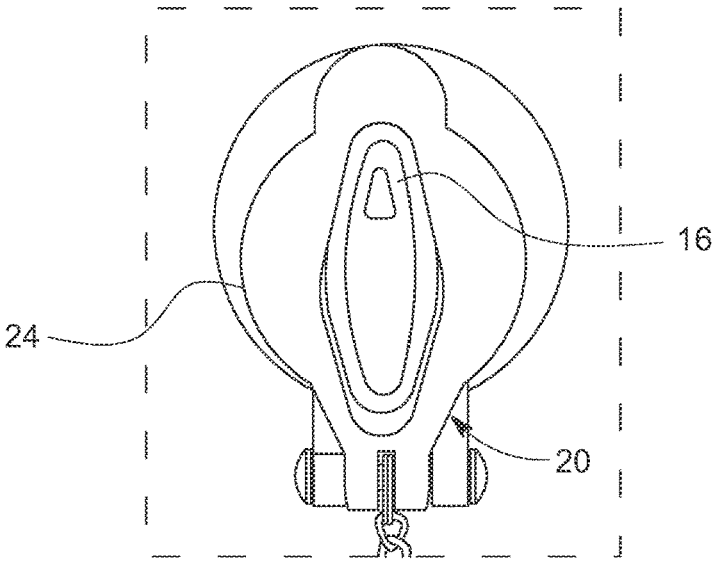
FIG. 17 is a view of the installed security device of FIGS. 16 and 16A, wherein the security device is in a closed or locked configuration and the deadbolt lever is in the locked position.
Figure 18:
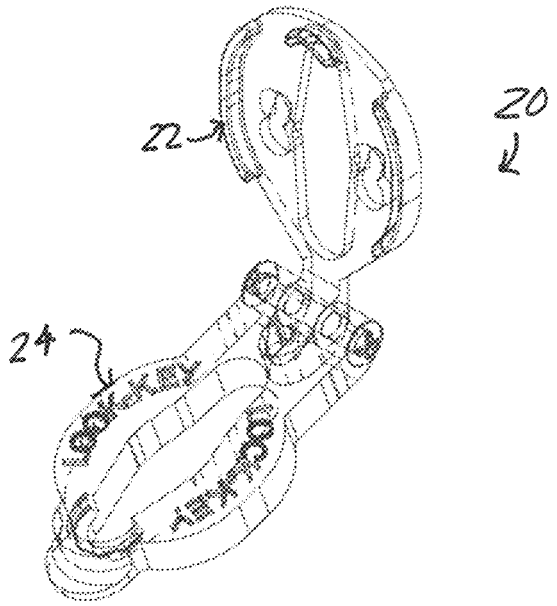
FIG. 18 is a perspective view of the security device of FIGS. 16 to 17, wherein the security device is partially open.
Figure 19:
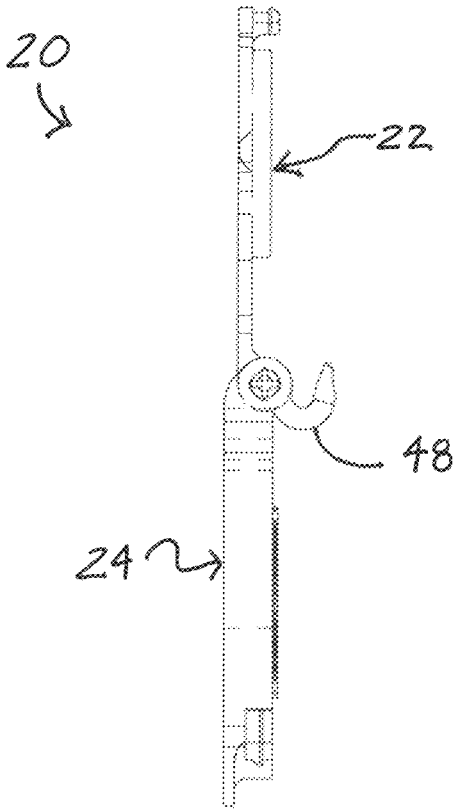
FIG. 19 is a right side view of the security device of FIG. 18, wherein the security device is fully open.
Figure 20:
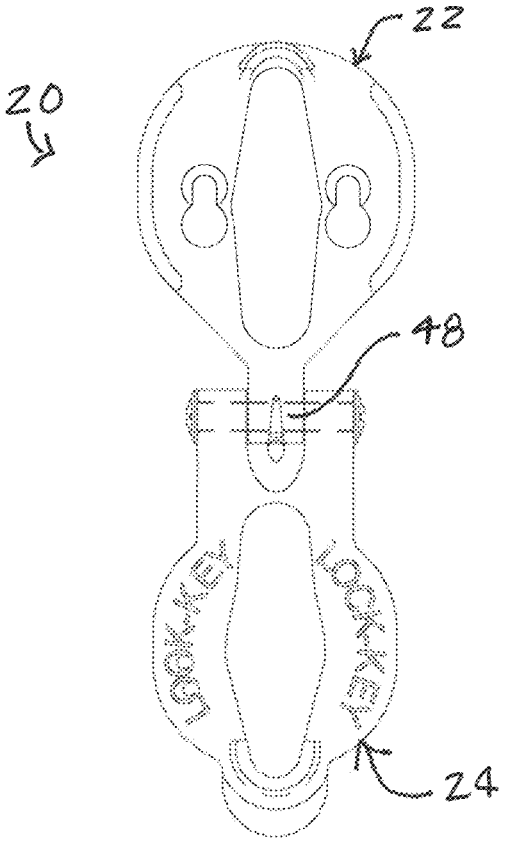
FIG. 20 is a front view of the security device of FIGS. 18 and 19.
Figure 21:
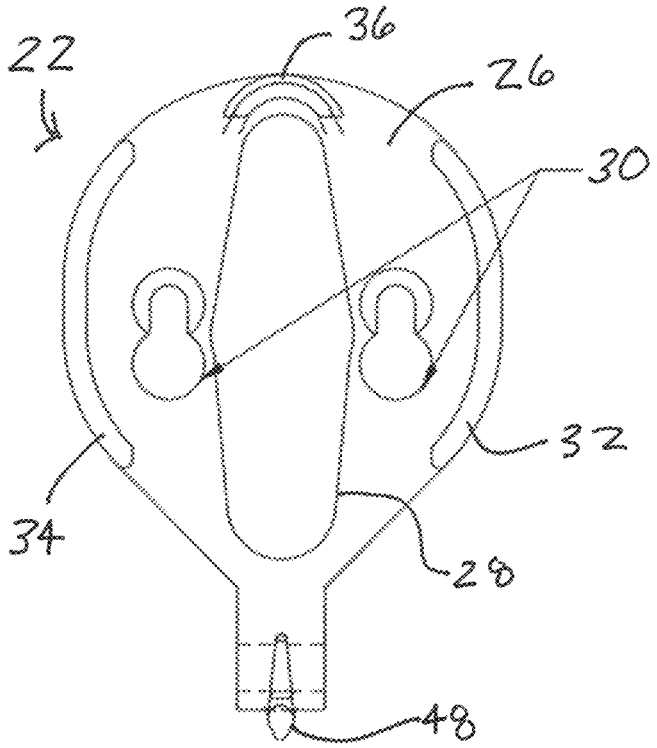
FIG. 21 is a front view of an exemplary base member of the security device of FIGS. 18 to 20.
Figure 22:
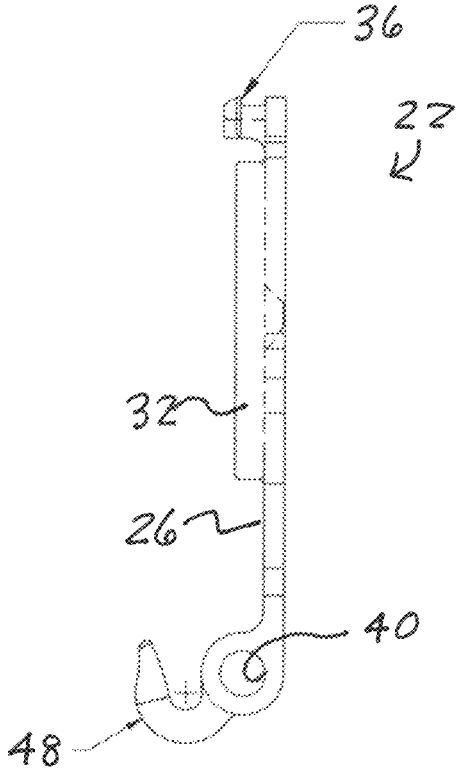
FIG. 22 is a left side view of the base member of FIG. 21.
Figure 23:
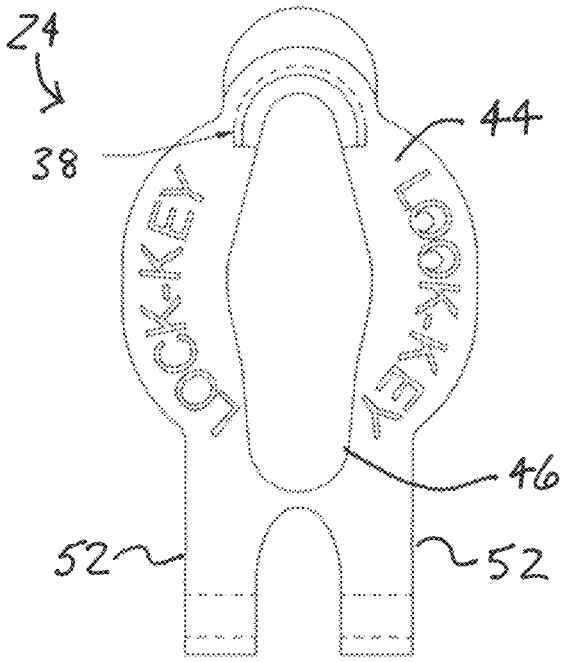
FIG. 23 is a front view of an exemplary lock member of the security device of FIGS. 18 to 20.
Figure 24:
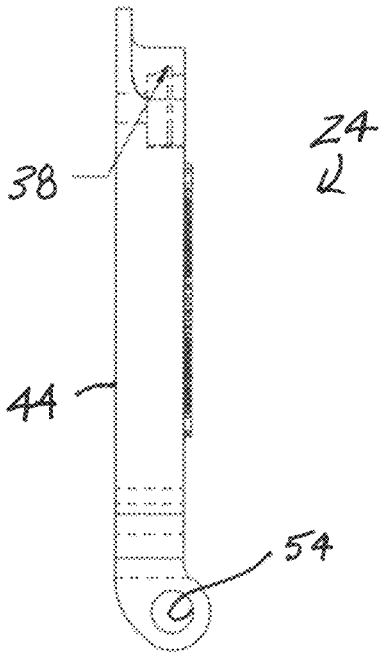
FIG. 24 is a left side view of the lock member of FIG. 23.

FIG. 15 illustrates the pivot member or pin 42 that extends through the passage 40 of the base member 22 and passages 54 of the lock member 24 to pivotably secure the lock member 24 to the base member 22. The illustrated pivot pin 42 is a M4 connecting bolt having a first externally threaded part 56 and a second internally-threaded part 58 sized for receiving the first part 56. The first and second parts 56, 58 of the pivot pin 42 each have a rounded head 60. The first and second parts 56, 58 of the pivot pin 42 are extending through the passage 40 of the base member 22 and the passages 54 of the lock member 24 and threaded together to form the pivot pin 42 of the pivoting connection between the base member 22 and the lock member 24. The illustrated lock member 24 pivots up to its locked position and down to its unlocked position about a horizontal and laterally extending pivot axis 62 formed by the pivot pin 42. It is noted that the pivot pin 42 and/or the pivot axis 62 can alternatively have any other suitable configuration.

The base member 22 and the lock member 24 are secured together by the pivot pin 42 in a clam shell like manner. When installed to the deadbolt door lock 10, the illustrated lock member 24 pivots between its closed or locked position inwardly adjacent the base member 22 while receiving the pivoting lever 16 therein to prevent movement of the pivoting lever 16 so that the deadbolt door lock 10 cannot be unlocked, and its open or unlocked position below and away from the base member 22 so that the pivoting lever 16 can be pivoted to lock and unlock the deadbolt door lock 10. The lock member 24 is retained in its closed position by the clasp 35. The illustrated clasp 35 secures the lock member 24 to the base member 22 by the interlocking first and second clasp members 36, 38 (best seen in FIG. 8). The illustrated first and second clasp members 36, 38 interlock with a pushing force and disconnect with a pulling force. It is noted that the clasp 35 can alternatively have any other suitable configuration.

To install the illustrated security device 20, the fasteners 18 of the deadbolt door lock 10 located at the interior face plate 12 are loosened with a screw driver or the like but are not removed. The fasteners 18 are loosened just enough so that the fastener heads can be passed through the large diameter portion of the fastener openings 30 in the base member 22. With the pivoting lever 16 in it locked position (substantially vertical), the base member 22 is moved over the pivoting lever 16 and over the fastener heads until the base member 22 engages the interior face plate. 12 The base member 22 is then moved downward so that the fasteners 18 slide from the large diameter portion to the small diameter portion of the fastener openings 30. The fasteners 18 are tightened with a screw driver or the like to clamp the base member 22 to the interior face plate 12 so that the base member 22 is secured to the interior face plate 12. Secured in this manner, the pivoting lever 16 can be freely moved to lock and unlock the deadbolt door lock 10 in a normal manner.

When it is desired to operate the illustrated security device 20 in order prevent movement of the pivoting lever 16, by hand or key, from its locked position, the lock member 24 is pivoted up from its open or unlocked position about the pivot pin 42 until it passes over the pivoting lever 16 to its closed position engaging the base member 22. The lock member 24 is pushed against the base member 22 with enough force so that the clasp 35 engages to secure the lock member 24 to the base member 22 in its closed or locked position. With the lock member 24 in its locked position, the pivoting lever 16 cannot be moved from its locked position by hand or key because the pivoting lever 16 engages and is blocked by the main wall 44 of the lock member 24. That is, the lock member 14 blocks movement of the pivoting lever 16 out of its locked position. Thus, the deadbolt door lock 10 cannot be unlocked even if a key is inserted and turned on the exterior side of the door 14. When it is desired to unsecure the deadbolt door lock 10, the top of the lock member 24 is pulled outward with enough force to release the clasp 35 and the lock member 24 is pivoted downward from its closed or locked position to its open or unlocked position. With the lock member 24 in its open or unlocked positon the deadbolt lock 10 can be unlocked by manually moving the pivoting lever 16 to its unlocked position on the interior side of the door 14 by hand or by inserting and turning the key on the exterior side of the door 14. Additionally, at any time keys can be stored on the hook 48 so that the location of the keys is known (best shown in FIGS. 2A and 3A).

FIGS. 16 to 24 illustrate a security device 20A according to a second embodiment the present invention. The illustrated security device 20A according to the second embodiment is substantially the same as the first embodiment of the invention except for the location of the key ring holder or hook 48. The hook 48 is located on the base member 22 rather than the lock member 24. The bottom of the base member rear wall 26 is provided with an upward directed and forwardly facing hook 48 sized and shaped to hang a keyring thereon. It is noted that the hook 48 can alternatively have any other suitable location or can alternatively be eliminated.

Any of the features or attributes of the above-described embodiments and variations can be used in combination with any of the other features and attributes of the above-described embodiments and variations as desired.

From the foregoing disclosure it will be apparent that the illustrated devices and methods for securing deadbolt door locks provide increased security in a simple and cost effective manner.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A device for securing a deadbolt lock for a door having an interior face plate secured by a pair of laterally spaced-apart mechanical fasteners and a lever movable between a locked position and an unlocked position, the device comprising, in combination:

a base member configured to be secured on top of the interior face plate opposite the door;

wherein the base member has a pair of laterally spaced apart openings for the mechanical fasteners of the deadbolt lock to pass through to secure the base member between the mechanical fasteners and the interior face plate;

a lock member pivotably secured to the base member so that the lock member pivots between an open position and a closed position; and wherein the lock member is configured to prevent movement of the lever from the locked position to the unlocked position when the lock member is in the closed position and to permit movement of the lever from the locked position to the unlocked position when the lock member is in the open position.

2. The device according to claim 1, further comprising a releasable clasp selectively securing the lock member to the base member by interlocking the lock member and the base member when the lock member is in the closed position.

3. The device according to claim 1, wherein the pair of laterally spaced apart openings in the base member are keyhole shaped.

4. The device according to claim 1, wherein the the base member includes left and right flanges configured to extend outwardly away from the door and extend along left and right side edges of the base portion.

5. The device according to claim 1, wherein the lock member and the base member are pivotably secured together by a horizontally extending pivot pin and the pivot pin is located at a bottom portion of the base member and a bottom portion of the lock member so that the lock member pivots down when moving from the closed position to the open position and hangs below the base member when in the open position.

6. The device according to claim 5, further comprising a releasable clasp located at a top portion of the base member and a top portion of the lock member and selectively securing the lock member to the base member by interlocking the lock member and the base member when the lock member is in the closed position.

7. The device according to claim 1, wherein the lock member includes a hook that is configured to hang a keyring therein and is located at the free end of the lock member so that the hook is forward facing and at a bottom of the lock member when the lock member is in the open position.

8. The device according to claim 1, wherein the base member and the lock member each comprise plastic.

9. The device according to claim 1, wherein the base member includes a forward facing hook that is configured to hang a keyring thereon and is located at the lower end of the base member.

10. The combination according to claim 9, wherein the lock member and the base member are pivotably secured together by a horizontally extending pivot pin and the pivot pin is located at a bottom portion of the base member and a bottom portion of the lock member so that the lock member pivots down when moving from the closed position to the open position and hangs below the base member when in the open position.

11. The combination according to claim 10, wherein the security device further comprises a releasable clasp located at a top portion of the base member and a top portion of the lock member and selectively securing the lock member to the base member by interlocking the lock member and the base member when the lock member is in the closed position.

12. The combination according to claim 9, wherein the base member and the lock member each comprise plastic.

13. A combination of a deadbolt lock and a security device, the combination comprising:

wherein the deadbolt lock includes:

an interior face plate secured by a pair of laterally spaced-apart mechanical fasteners; and a lever movable between a locked position and an unlocked position;

wherein the security device includes:

a base member configured to be secured on top of the interior face plate opposite the door;

wherein the base member has a pair of laterally spaced apart openings for the mechanical fasteners of the deadbolt lock to pass through to secure the base member between the mechanical fasteners and the interior face plate;

a lock member pivotably secured to the base member so that the lock member pivots between an open position and a closed position; and wherein the lock member is configured to prevent movement of the lever from the locked position to the unlocked position when the lock member is in the closed position and to permit movement of the lever from the locked position to the unlocked position when the lock member is in the open position.

14. The combination according to claim 13, wherein the security device further comprises a releasable clasp selectively securing the lock member to the base member by interlocking the lock member and the base member when the lock member is in the closed position.

15. The combination according to claim 13, wherein the pair of laterally spaced apart openings in the base member are keyhole shaped.

16. The combination according to claim 13, wherein the the base member includes left and right flanges that extend outwardly away from the door and extend along left and right side edges of the base portion.

17. The combination according to claim 10, wherein the lock member includes a hook that is configured to hang a keyring therein and is located at the free end of the lock member so that the hook is forward facing and at a bottom of the lock member when the lock member is in the open position.

18. The combination according to claim 10, wherein the base member includes a forward facing hook that is configured to hang a keyring thereon and is located at the lower end of the base member.

19. A method for securing a deadbolt lock having an interior face plate secured by a pair of laterally spaced apart mechanical fasteners and a lever movable between locked and unlocked positions, the method comprising the steps of:

obtaining a security device including:

a base member configured to be secured on top of the interior face plate of the deadbolt lock;

wherein the base member has a pair of laterally spaced apart openings for the mechanical fasteners of the deadbolt lock to pass through to secure the base member between the mechanical fasteners and the interior face plate on top of the interior face plate;

a lock member pivotably secured to the base member so that the lock member pivots between an open position and a closed position; and wherein the lock member is configured to prevent movement of the lever from the locked position to the unlocked position when the lock member is in the closed position and to permit movement of the lever from the locked position to the unlocked position when the lock member is in the open position;

pivoting the lock member from the open position to the closed position when the lever is in the locked position to prevent movement of the lever from the locked position to the unlocked position; and pivoting the lock member from the closed position to the open position to permit movement of the lever from the locked position to the unlocked position.

20. The method according to claim 19, wherein the lock member and the base member are pivotably secured together by a horizontally extending pivot pin and the pivot pin is located at a bottom portion of the base member and a bottom portion of the lock member so that the step of pivoting the lock member from the closed position to the unlocked position includes pivoting the lock member down to the open position so that it hangs down below the base member.

* * * * *